US006069545A

United States Patent [19]

Van Zeeland

[11] Patent Number: 6,069,545

[45] Date of Patent: May 30, 2000

[54] MAGNETICALLY ACTUATED PUSHBUTTON SWITCH

[75] Inventor: Anthony J. Van Zeeland, Mesa, Ariz.

[73] Assignee: DuraSwitch Industries, Inc., Mesa, Ariz.

[21] Appl. No.: 09/227,368

[22] Filed: Jan. 8, 1999

[51] Int. Cl.[7] ..... H01H 9/00; H01H 13/58; H01H 19/62

[52] U.S. Cl. ..... 335/207; 335/205; 335/206; 200/526; 200/527; 200/517

[58] Field of Search ..... 335/205–208, 335/229–234; 200/517, 523–526, 527, 528

[56] References Cited

U.S. PATENT DOCUMENTS 4,950,856 8/1990 Valenzona ..... 200/526

*Primary Examiner*—Michael L. Gellner
*Assistant Examiner*—Raymond Barrera
*Attorney, Agent, or Firm*—Dorn, McEachran, Jambor & Keating

[57] ABSTRACT

An electrical switch has a set of electrodes mounted on one side of a carrier. The opposite side of the carrier mounts an actuator having a plunger mounted for reciprocating motion. The plunger carries a coupler in the form of magnets. A conductive armature of magnetic material is disposed on the electrode side of the carrier. When the plunger withdraws the coupler magnets from the carrier, the armature is free to fall out of contact with the electrodes. A retention cover maintains the armature in the vicinity of the carrier such that subsequent movement of the coupler proximate the carrier will draw the armature back into contact with the electrodes.

27 Claims, 2 Drawing Sheets

MAGNETICALLY ACTUATED PUSHBUTTON SWITCH

BACKGROUND OF THE INVENTION

This invention relates to magnetically actuated switches of the type having a carrier with switch contacts on one side thereof which are selectively bridged by a movable conductive armature. The armature's movement into and out of shorting relation with the spaced contacts is governed by a coupler mounted for movement on the opposite side of the carrier. One of the coupler and armature is a magnet and the other is made of magnetic material. By magnetic material it is meant that the material is affected by a magnet. Thus, the armature is magnetically coupled to the coupler and generally moves therewith to either short or open the switch contacts.

Switches of this general nature are shown and described in U.S. Pat. Nos. 5,666,096 and 5,523,730 and U.S. Pat. No. 5,867,082 and U.S. patent application Ser. No. 09/160,645, filed Sep. 28, 1998, the disclosures of which are hereby incorporated by reference. The present invention is an extension of this technology in the area of pushbutton switches.

One of the advantages of magnetically actuated switches is that switch closure can be effected with very little travel of the movable parts. In some applications, however, it is desirable to allow full travel of an actuator even though only a minor portion of the full travel is needed to close the switch. For example, users of some consumer products, through long experience with conventional full travel switches, come to expect a particular type of switch actuator. Manufacturers often find it preferable to accommodate that expectation rather than try to retrain consumers to accept a switch with minimal travel. Other switches may require relatively large actuators so they can be found and manipulated more or less by touch rather than visually. Automobile dashboard controls are an example.

Another difficulty in switch design is combining multiple switches in a single actuator. Combination switches are desirable to eliminate clutter and minimize the size of control panels. Applications such as automotive sound systems utilize combined rotary and pushbutton switches to control volume and display functions (e.g., time of day or selected radio frequency), respectively. The mechanical requirements of making and breaking two sets of contacts with one actuator typically result in complex, and therefore expensive, switch designs.

SUMMARY OF THE INVENTION

The present invention is directed to magnetically actuated electrical switches. It is particularly concerned with a pushbutton switch of this type which accommodates a full travel actuator.

Another object of the invention is a magnetically actuated switch which can be adapted for a combined rotary and pushbutton switch.

A further object of the invention is a switch of the type described which can be provided with a push-push mechanism. A push-push mechanism holds a pushbutton actuator in a first position and then in a second position on alternate actuations thereof. One position may be referred to as a retracted or closed position and the other as a released or open position. A common example of a push-push mechanism is a retractable ball point pen whose tip is alternately extended and held in a writing position upon one actuation of the top end pushbutton and then withdrawn into the barrel upon the next actuation of the pushbutton.

These and other objects of the invention which may become apparent are realized by a switch having first and second sets of electrodes mounted on one side of a carrier. The opposite side of the carrier mounts an actuator having a bushing fixed to the carrier with a rotatable sleeve therein. A plunger slidingly engages an opening in a rotor, both within the bushing. The plunger is mounted for reciprocating motion toward and away from the electrodes while the rotor rotates opposite the electrodes. The plunger and rotor carry first and second couplers in the form of magnets. First and second armature on the one side of the carrier are moved relative to the electrodes under the influence of the magnetic attraction of the coupler magnets. When the plunger withdraws its first coupler magnets from the carrier, the first armature is free to fall away from the carrier and, therefore, from the first set of electrodes. A retention cover maintains the first armature in the vicinity of the carrier such that subsequent movement of the first coupler proximate the carrier will draw the first armature back into contact with the first electrodes.

DETAILED DESCRIPTION OF THE INVENTION

Figure 1:
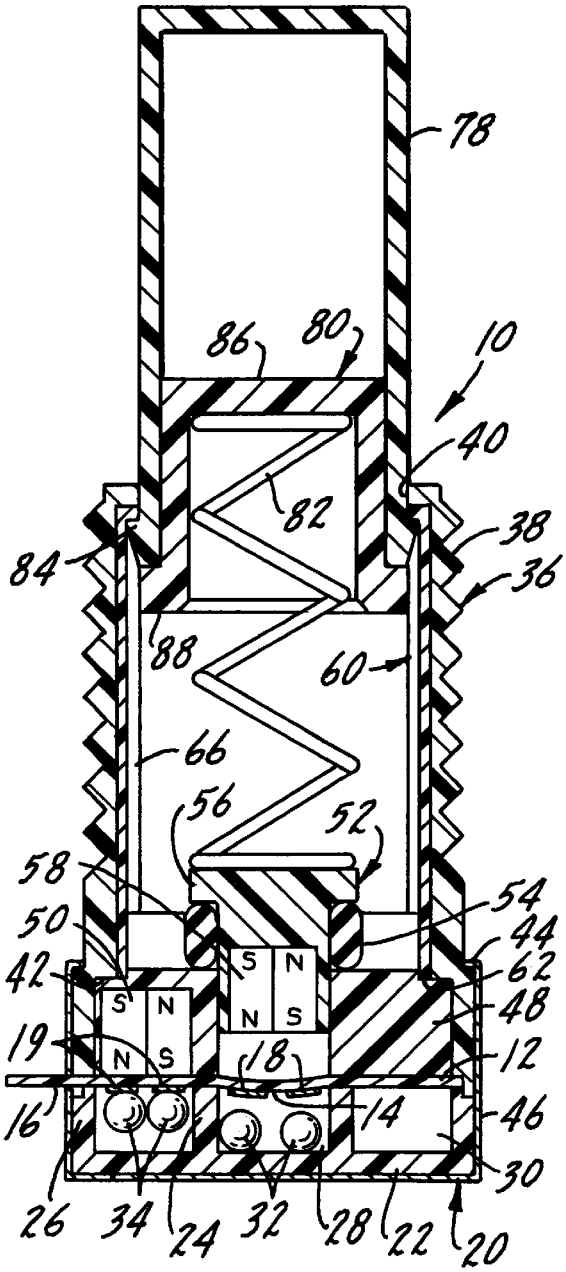
FIG. 1 is a section through a combined pushbutton rotary switch in an open position.
Figure 2:
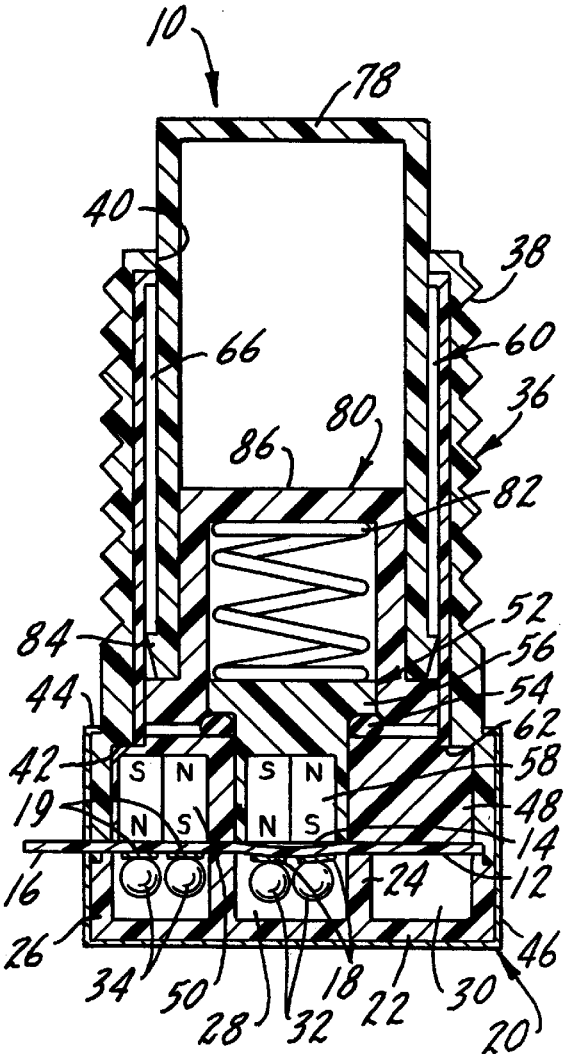
FIG. 2 is a section similar to FIG. 1 showing the switch in a retracted position.

FIGS. 1 and 2 illustrate the switch 10 of the present invention. It includes a carrier 12 of planar construction except for a ridge 14. The ridge serves as a partition for separating the ball armature, as will be explained below. The carrier can be any suitable non-conductive material such as polyester. Or, if the carrier will be used for mechanical mounting of the switch, it could be made of a more rigid member such as a printed circuit board. The carrier may have a tail portion 16 for providing suitable electrical connection to associated electronics.

The bottom surface of the carrier has electrical conductors formed thereon, such as by screen printing or other suitable technique. The conductors are shown schematically at 18 and 19 and are referred to herein as first and second sets of electrodes. The electrodes can be laid out in any desired arrangement that may include contact pads, resistive strips, take-off strips and leads for any of these extending to the tail 16. It will be understood that the electrodes may be arranged into spaced switch contact pads to be shorted or opened by an armature. Or the electrodes may be configured into a potentiometer having an armature for a wiper which continuously bridges a resistive strip and a take-off strip. The term electrodes is intended to cover any desired arrangement of the electrical conductors. In the embodiment shown the electrodes 18 are contact pads of a switch and the electrodes 19 are the arcuate strips of a potentiometer.

The surface of the carrier 12 bearing the electrodes 18 is enclosed by a containment cover 20. The cover has a plate 22, an inner wall 24 and an outer wall 26. Although it is not necessary, the plate is typically circular and the inner and outer walls and are concentric cylinders coaxial with the center of the plate. Together with the carrier 12, the cover 20 and walls 24, 26 define two spaces, a chamber 28 and a race 30. The chamber 28 encompasses the ridge 14. Within chamber 28 is a first armature 32. In this embodiment the armature is a pair of conductive, spherical balls, although the armature shape could be otherwise as shown in the above-referenced patents. Race 30 contains the second armature 34, also in the form of conductive, spherical balls. While it is preferred that the cover 20 fully enclose chamber 28 and race 30 to protect the armatures and electrodes from dirt and fluids, the cover could have openings therein so long as the balls of the first armature 32 cannot escape the chamber 28. The volume of chamber 28 and diameter of the balls are selected in conjunction with the magnetic transmissivity of the carrier 12 and the strength of the coupler magnets (described below) such that the first armature balls can fall out of contact with the carrier but only so far as to be certain that when the magnets are placed proximate the carrier the balls will be drawn into contact with the electrodes 18. In other words, the balls are always subject to the magnetic attractive force of a proximate magnet.

On the side of the carrier 12 opposite the cover 20 is a bushing 36. The bushing is generally cylindrical and may be fixed to the cover outer wall 26 by a tongue and groove as shown. External threads 38 facilitate attachment of the switch 10 to a control panel by a nut (not shown). The hollow interior of the bushing terminates at the upper end at a lip 40. The base of the bushing has an offset forming internal and external shoulders 42 and 44. The bushing 36 and containment cover 20 are further held together by a metal sheath 46 which engages the external shoulder 44. Sheath 46 also provides magnetic shielding.

A rotor 48 is mounted for rotation adjacent the top surface of the carrier 12. The rotor cannot move away from the carrier due to the constraint of the internal shoulder 42 but the rotor is free to rotate. The rotor has a receptacle therein which receives a second coupler 50 in the form of a pair of permanent magnets having poles as shown. The coupler magnets are constrained to rotate with the rotor adjacent the carrier. The magnets are located so as to rotate just above the race 30. Accordingly, the magnets 50 hold the second armature balls 34 against the underside of the carrier and in contact with the electrodes 19. The balls 34 provide an electrical path between the electrodes and will follow the magnets around the race 30 as the magnets are moved by the rotor 48.

The rotor has a central bore just above the chamber 28. The bore receives a plunger 52. Preferably the bore has a non-circular shape which the plunger matches so the rotor and plunger rotate together. For example, the rotor and plunger may be splined or keyed together. It is necessary that the plunger be permitted to reciprocate axially within the bore. Thus, the plunger is mounted for reciprocating movement toward and away from the chamber 28. Such motion away from the chamber is caused by a return spring 54 which biases the plunger away from the carrier and chamber 28. In the embodiment shown the return spring 54 is a flexible rubber ring, although a coil spring could be used. The return spring rests on top of the rotor 48 and underneath a flange 56 of the plunger.

The base of the plunger 52 has a receptacle for receiving the first coupler 58 in the form of a pair of permanent magnets having poles as shown. The coupler magnets are constrained to rotate and reciprocate with the plunger. The reciprocating motion carries the magnets 58 proximate to the chamber 28 (as in FIG. 2) and remote from the chamber 28 (as in FIG. 1). "Proximate to" means the magnetic attraction between the magnets 58 and first armature balls 32 is strong enough to pull the balls against the carrier 12 (and therefore against the electrodes 18). "Remote from" means the magnetic attraction between the magnets 58 and first armature balls 32 is not strong enough to hold the balls against the carrier 12. Together the armature and coupler form an actuator for selectively opening and closing the switch.

The internal wall of the bushing 36 is lined by a rotatable sleeve 60. The bottom edge 62 of the sleeve fits around a boss formed on the top of the rotor 48. The sleeve is keyed to the rotor so the rotor and sleeve rotate as one. The lip 40 on the top of the bushing prevents axial motion of the sleeve.

Figure 3:
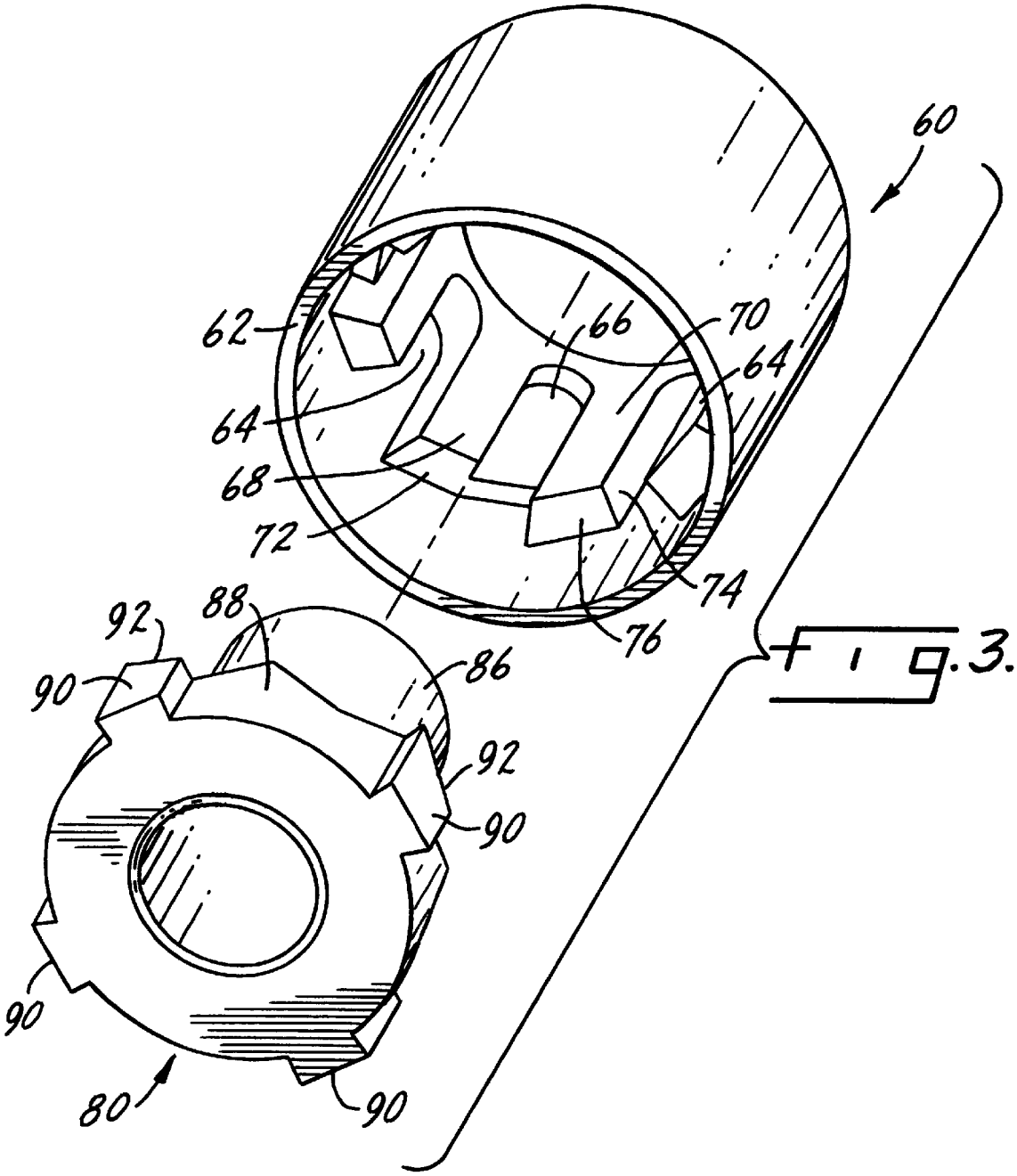
FIG. 3 is a perspective view of a bushing sleeve and latch component.

FIG. 3 illustrates the internal construction of the sleeve 60. The upper portion of the sleeve internal wall has an area of reduced internal diameter. Cut into this protruding portion are four axially-extending grooves 64 and four axially-extending slots 66 which are shallower than the grooves. Separating the grooves 64 and slots 66 are alternating short blocks 68 and long blocks 70. The short blocks 68 and slots 66 terminate at their lower ends at angled stop faces 72. The long blocks 70 extend below the stop faces to form a pawl 74 having a pawl face 76 on the bottom thereof. Each of the four grooves, slots, long blocks and short blocks extends 22½° around the internal wall of the sleeve.

The sleeve 60 cooperates with a keycap 78, latch 80 and spring 82 to form a push-push mechanism. The spring 82 has a higher spring rate than the plunger spring 54. The keycap 78 is a hollow cylinder, closed at its upper end and having eight equally spaced hooks 84 disposed on 45° centers about the periphery of its lower edge. The hooks extend to the depth of the slots 66 and have a width just slightly less than that of the slots and grooves 64. Thus, the hooks are disposed in the slots and grooves, allowing axial movement of the keycap 78 relative to the sleeve 60 but locking them together rotationally. At the upper termination of the grooves and slots the hooks engage the protruding portion of the sleeve to prevent the keycap 78 from coming out of the bushing 36. The lower edge of the keycap also has angled cam surfaces engaging similar surfaces of the latch 80.

The latch 80 has a central hub 86 which fits telescopically inside the lower end of the keycap 78. The latch is urged into the keycap by the spring 82. As seen in FIG. 3, the bottom edge of the hub has a flange 88 with four cogs 90 extending beyond the periphery of the flange. The cogs are on 90° centers. The upper edges of the flange and cogs have angled cam surfaces 92 which engage the cam surfaces on the bottom of the keycap 78. The cams are arranged such that when the keycap is depressed by a user, the downward force on the latch tends to rotate the latch. The outside diameter of the cogs is such that they will fit into the grooves 64 but they will not fit into the shallow slots 66. It follows that the cogs will also not clear the long or short blocks 68 and 70.

The use, operation and function of the invention are as follows. Considering first the electrical aspects of the switch 10, the first armature 32 is spaced from electrodes 18 when the first coupler magnets 58 are remote from the chamber 28, as in FIG. 1. The return spring 54 biases the plunger 52 away from chamber 28 when the keycap is in a raised position. The armature balls 32 fall away from the electrodes to the extent permitted by the containment cover 20. If the switch is turned upside down from the orientation of FIG. 1, gravity will place the armature balls in contact with the carrier and each ball will contact one of the electrodes 18. But the ridge 14 will also force the balls toward the inner walls 24 and away from one another. Thus, the balls will not contact one another and there will be no conductive path from one electrode pad to the other. The switch will remain open regardless of its orientation.

When a user depresses the keycap to its lowered or retracted position as seen in FIG. 2, the spring 82 will be compressed, overcoming the bias of return spring 54, and forcing the plunger downwardly. This carries the first coupler magnets 58 proximate to the chamber 28. The magnetic attraction between magnets 58 and first armature balls 32 draws the balls up against the electrodes 18 and against one another, despite the presence of the ridge 14. This shorts the electrode pads and closes the switch. It can be seen that the ridge is low enough to fit in the interstice between the balls.

The second coupler 50 is always adjacent the race 30 so the second armature balls 34 are always in contact with electrodes 19. The armature 34 simply follows the coupler 50 around the race. Since the rotor 48 is always free to rotate, the coupler 50 will rotate whenever the user turns the keycap, regardless of whether the keycap is up or down.

Turning now to the push-push mechanism, its operation is as follows. To obtain the open position of FIG. 1, the cogs 90 have to be oriented so as to be aligned with the grooves 64. This allows the spring 82 to raise the latch 80 and keycap 78 to the open position of FIG. 1. Then when a user pushes the keycap down the cam surfaces of the keycap apply a rotational force on the latch but it cannot rotate immediately due to the cogs 90 engagement with the grooves 64. The keycap and latch move downwardly, closing the switch 18 as described above. When the cogs clear the bottom of the short blocks 68, i.e., when they come out of the grooves, the latch rotates or indexes the cogs toward the pawls 74. This places the cogs in alignment with the stop faces 72 of the short blocks 68. The cogs cannot rotate all the way to the pawls until the user removes pressure on the keycap. Then the engagement of the cam faces 92 with the stop faces 72 allows the upward spring force to finish rotating the latch until the cogs engage the pawls 74 and are aligned with the slots 66. Since the cogs cannot fit into the slots, the cogs hold the latch down against the combined upward force of the springs 54 and 82.

When a subsequent actuating force is applied by a user, the keycap bottom surfaces again urge the latch rotationally but no rotation can occur until the latch is depressed slightly and the cogs 90 clear the bottom of the pawls 74. When they clear, the latch rotates so the cogs align with the long blocks 70. At this orientation engagement of the cogs' cam surfaces 92 with the pawl faces 76 causes the latch to index or rotate another 22½° under the force of the springs and cams. This aligns the cogs with the deep grooves 64 so when the actuating force is removed the springs can push the latch and keycap up to the position of FIG. 1. This lets the plunger 52 move up to a position remote from the chamber 28 so first armature balls 32 fall out of engagement with the electrodes 18, thereby opening the switch as described above.

While a preferred form of the invention has been shown and described, it will be realized that alterations and modifications may be made thereto without departing from the scope of the following claims. For example, while the switch has been shown and described as a pushbutton switch combined with a rotary switch, it could be just a pushbutton switch alone. In that case the grooves, slots and blocks of the push-push mechanism could be formed directly on the inside wall of the bushing, without the need for a rotatable sleeve. Or the switch could be just a slide switch alone. That is, instead of the coupler moving generally perpendicularly to the plane of the carrier, it could move parallel to the carrier until it is beyond the boundaries of the chamber 28. The chamber inner wall 24 would prevent the armature from following the coupler, thereby releasing the armature 32 into the chamber. Sliding return of the coupler over the chamber 28 would again pull the armature into contact with the contacts, thereby closing the switch.

A further alternate construction could have a plunger with legs that extend through openings in the carrier to mount a second set of magnets on the bottom side of the chamber. Thus, there are magnets both above and below the chamber. Pushing the plunger in will place a first set of magnets proximate to the chamber and the second set of magnets remote from the chamber. The first set of magnets will pull the armature up and close the switch, substantially as shown. Releasing the plunger will carry the first set of magnets up and out of magnetic range of the armature but this action will simultaneously bring the second set of magnets into range from the bottom of the chamber. This will pull the armature down and out of engagement with the contacts, opening the switch.

What is claimed is:

1. An electrical switch, comprising:

a carrier having first and second surfaces;

a set of electrodes disposed on one of said carrier surfaces and defining at least one pair of spaced switch contacts;

a containment cover on said one of the carrier surfaces, the containment cover and carrier together defining an enclosed chamber encompassing the switch contacts;

an actuator for selectively opening or closing the switch contacts, the actuator comprising an electrically conductive armature disposed within the chamber, and a first coupler mounted on the other of the carrier surfaces for reciprocating movement toward and away from the chamber, one of the coupler and armature being a permanent magnet and the other being made of magnetic material, the coupler being movable close enough to the chamber such that magnetic attraction between the coupler and armature draws the armature into shorting relation with the switch contacts, and the coupler being movable far enough away from the chamber to release the armature from contact with the carrier.

2. The switch of claim 1 wherein the actuator further comprises:

a generally hollow bushing attached to said other surface of the carrier;

a plunger slidably mounted in the bushing, the coupler being connected to the plunger for movement therewith.

3. The switch of claim 2 further comprising a first spring biasing the plunger away from the carrier.

4. The switch of claim 2 further comprising a push-push mechanism engageable with the plunger.

5. The switch of claim 4 wherein the bushing has an inner wall and the push-push mechanism comprises a plurality of axially-extending grooves on the inner wall, a plurality of stops located between the grooves and axially spaced from the carrier, a latch slidably mounted in the bushing and having at least one cog slidably engageable with said grooves or interferingly engageable with said stops depending on the orientation of the cog, a return spring biasing the latch out of the bushing, a keycap slidably mounted in the bushing, the keycap and latch having interengaging cam surfaces which index the latch each time a user pushes on the keycap to alternately align the cog with a stop or a groove.

6. The switch of claim 5 further comprising a first spring biasing the plunger away from the carrier and the return spring is located between the plunger and latch.

7. The switch of claim 1 further characterized in that the armature is at least two conductive balls.

8. The switch of claim 7 further comprising a partition on the carrier that separates the balls from one another while they are in contact with the carrier in the absence of magnetic attractive force from the coupler.

9. The switch of claim 8 wherein the partition comprises a ridge in the carrier.

10. The switch of claim 1 further comprising:

a second set of spaced electrodes disposed on said one of the carrier surfaces, the actuator further comprising a second electrically conductive armature disposed on said one of the carrier surfaces, and a second coupler movably mounted on the other of the carrier surfaces, one of the second coupler and second armature being a permanent magnet and the other of the second coupler and second armature being made of magnetic material such that the second armature is held in engagement with said one surface of the carrier by the magnetic attraction between the second coupler and second armature, movement of the second coupler causing corresponding movement of the second armature with respect to the second set of spaced electrodes.

11. The switch of claim 10 wherein the actuator further comprises:

a generally hollow bushing attached to said other surface of the carrier;

a plunger slidably mounted in the bushing, the first coupler being connected to the plunger for movement therewith;

a rotor mounted in the bushing for rotation adjacent said other surface of the carrier, the second coupler being connected to the rotor for movement therewith.

12. The switch of claim 11 wherein the rotor has a central opening for receipt of the plunger, the opening and plunger being shaped such that the rotor and plunger are rotationally locked to one another but slidable with respect to one another.

13. The switch of claim 12 further comprising a push-push mechanism engageable with the plunger.

14. The switch of claim 13 wherein the bushing has an inner wall and the push-push mechanism comprises a plurality of axially-extending grooves on the inner wall, a plurality of stops located between the grooves and axially spaced from the carrier, a latch slidably mounted in the bushing and having at least one cog slidably engageable with said grooves or interferingly engageable with said stops depending on the orientation of the cog, a return spring biasing the latch out of the bushing, a keycap slidably mounted in the bushing, the keycap and latch having interengaging cam surfaces which index the latch each time a user pushes on the keycap to alternately align the cog with a stop or a groove.

15. The switch of claim 14 wherein the inner wall of the bushing comprises a sleeve mounted for rotation.

16. The switch of claim 15 further comprising a first spring biasing the plunger away from the carrier and the return spring is located between the plunger and latch.

17. The switch of claim 15 wherein the keycap includes projections engageable with the grooves to rotationally lock the keycap and sleeve together.

18. The switch of claim 10 wherein the containment cover and carrier together define a second enclosed chamber adjacent the second set of spaced electrodes with the second armature disposed in said second chamber.

19. A combination pushbutton and rotary switch, comprising:

a carrier having first and second surfaces with first and second sets of electrodes on one surface of the carrier;

first and second armatures associated with the first and second sets of electrodes respectively;

an actuator on the other surface of the carrier, the actuator including a plunger mounted for reciprocating movement toward and away from the first set of electrodes and a rotor mounted for rotary movement opposite the second set of electrodes;

first and second couplers attached to the plunger and rotor, respectively;

one of the second coupler and second armature being a permanent magnet and the other being made of magnetic material such that the second armature is held in engagement with said one surface of the carrier by the magnetic attraction between the second coupler and second armature, movement of the rotor causing corresponding movement of the second armature with respect to the second set of spaced electrodes;

one of the first coupler and first armature being a permanent magnet and the other being made of magnetic material such that when the plunger places the first coupler proximate to the carrier the first armature is held in engagement with said first set of electrodes by the magnetic attraction between the first coupler and first armature, and when the plunger places the first coupler remote from the carrier the first armature is released from contact with the carrier; and a containment cover on said one of the carrier surfaces enclosing at least the first armature.

20. The switch of claim 19 wherein the containment cover encloses both the first and second armatures.

21. The switch of claim 19 wherein the rotor has a central opening for receipt of the plunger, the opening and plunger being shaped such that the rotor and plunger are rotationally locked to one another but slidable with respect to one another.

22. The switch of claim 21 further comprising a push-push mechanism engageable with the plunger.

23. The switch of claim 22 wherein the actuator further comprises a bushing having a sleeve mounted for rotation and wherein the push-push mechanism comprises a plurality of axially-extending grooves on the sleeve, a plurality of stops located between the grooves and axially spaced from the carrier, a latch slidably mounted in the bushing and having at least one cog slidably engageable with said grooves or interferingly engageable with said stops depending on the orientation of the cog, a return spring biasing the latch out of the bushing, a keycap slidably mounted in the bushing, the keycap and latch having interengaging cam surfaces which index the latch each time a user pushes on the keycap to alternately align the cog with a stop or a groove.

24. The switch of claim 23 further comprising a first spring biasing the plunger away from the carrier and the return spring is located between the plunger and latch.

25. The switch of claim 24 wherein the keycap includes projections engageable with the grooves to rotationally lock the keycap and sleeve together.

26. An electrical switch of the type having a generally hollow bushing with an inner wall and a plunger slidably mounted in the bushing, a set of electrodes defining at least one pair of spaced switch contacts associated with the plunger for selective opening or closing of the switch contacts, the improvement comprising a push-push mechanism engageable with the plunger and including:

a generally cylindrical sleeve mounted for rotation in the bushing and having an inner surface;

a plurality of axially-extending grooves on the inner surface of the sleeve, a plurality of stops located between the grooves, a latch slidably mounted in the bushing and having at least one cog slidably engageable with said grooves or interferingly engageable with said stops depending on the orientation of the cog, a return spring biasing the latch out of the bushing, a keycap slidably mounted in the bushing, the keycap and latch having interengaging cam surfaces which index the latch each time a user pushes on the keycap to alternately align the cog with a stop or a groove.

27. The switch of claim 26 further comprising a first spring biasing the plunger out of the bushing and the return spring is located between the plunger and latch.

* * * * *